US007464764B2

(12) United States Patent
Xu

(10) Patent No.: US 7,464,764 B2
(45) Date of Patent: Dec. 16, 2008

(54) RETRACTABLE BALL SEAT HAVING A TIME DELAY MATERIAL

(75) Inventor: Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 121 days.

(21) Appl. No.: 11/522,722

(22) Filed: Sep. 18, 2006

(65) Prior Publication Data

US 2008/0066924 A1 Mar. 20, 2008

(51) Int. Cl.
*E21B 29/00* (2006.01)

(52) U.S. Cl. ..... 166/376; 166/317

(58) Field of Classification Search ..... 166/376, 166/317, 318, 325, 332.4
See application file for complete search history.

(56) References Cited

U.S. PATENT DOCUMENTS

| | | | | |
|---|---|---|---|---|
| 3,211,232 | A | 10/1965 | Grimmer | |
| 4,194,566 | A | 3/1980 | Maly | |
| 4,314,608 | A | 2/1982 | Richardson | |
| 4,374,543 | A | 2/1983 | Richardson | |
| 4,390,065 | A | 6/1983 | Richardson | |
| 5,335,727 | A * | 8/1994 | Cornette et al. | 166/278 |
| 5,479,986 | A | 1/1996 | Gano et al. | |
| 5,685,372 | A | 11/1997 | Gano | |
| 5,709,269 | A | 1/1998 | Head | |
| 5,765,641 | A | 6/1998 | Shy et al. | |
| 5,992,289 | A | 11/1999 | George et al. | |
| 6,026,903 | A | 2/2000 | Shy et al. | |
| 6,076,600 | A | 6/2000 | Vick, Jr. et al. | |
| 6,155,350 | A | 12/2000 | Melenyzer | |
| 6,189,618 | B1 | 2/2001 | Beeman et al. | |
| 6,220,350 | B1 | 4/2001 | Brothers et al. | |
| 6,279,656 | B1 | 8/2001 | Sinclair et al. | |
| 6,382,234 | B1 | 5/2002 | Birckhead et al. | |
| 6,431,276 | B1 | 8/2002 | Robb et al. | |
| 6,779,600 | B2 | 8/2004 | King et al. | |
| 7,021,389 | B2 * | 4/2006 | Bishop et al. | 166/373 |
| 2003/0037921 | A1 | 2/2003 | Goodson | |

(Continued)

FOREIGN PATENT DOCUMENTS

| | | | |
|---|---|---|---|
| EP | 0518371 | A3 | 12/1992 |

(Continued)

OTHER PUBLICATIONS

Baker Hughes Incorporated, Model "E" Hydro-Trip Pressure Sub, Product Family No. H79928, Sep. 25, 2003, pp. 1-4, Baker Hughes Incorporated, Houston, Texas, USA.

(Continued)

*Primary Examiner*—William P Neuder
(74) *Attorney, Agent, or Firm*—Greenberg Traurig LLP; Anthony F. Matheny

(57) ABSTRACT

Retractable ball seats having a housing, a seat, and a plug such as a ball are disclosed. The seat has a retracted position that prohibits the ball from passing through the passageway and an expanded position that permits the ball to pass through the passageway. A time delay material, such as a dissolvable material, maintains the seat in the retracted position. The time delay material disintegrates, degrades, or dissolves within a known period of time such that the retractable ball seat can be placed in a desired location in the wellbore and the ball will be released through the passageway within a known period of time.

23 Claims, 3 Drawing Sheets

U.S. PATENT DOCUMENTS

| | | | | |
|---|---|---|---|---|
| 2005/0092363 | A1 | 5/2005 | Richard et al. | |
| 2005/0092484 | A1 | 5/2005 | Evans | |
| 2005/0161224 | A1 | 7/2005 | Starr et al. | |
| 2005/0205264 | A1 | 9/2005 | Starr et al. | |
| 2006/0131031 | A1 * | 6/2006 | McKeachnie et al. | 166/376 |

FOREIGN PATENT DOCUMENTS

| | | | |
|---|---|---|---|
| EP | 0518371 | B1 | 12/1992 |
| EP | 0999337 | B1 | 2/2006 |

OTHER PUBLICATIONS

Innicor Completion Systems, HydroTrip Plug Sub, Product No. 658-0000, Jul. 26, 2004, p. 1, Innicor Completion Systems, Canada.

TAFA Incorporated, Application Data, TAFA Series 300-301 Dissolvable Metal, 1989, pp. 1-3, TAFA Incorporated, Concord, New Hampshire, USA.

* cited by examiner

RETRACTABLE BALL SEAT HAVING A TIME DELAY MATERIAL

BACKGROUND

1. Field of Invention

The present invention is directed to retractable ball seats for use in oil and gas wells and, in particular, to retractable ball seats having time delay materials for releasing the ball.

2. Description of Art

Retractable ball seats are generally known in the art. For example, U.S. Pat. No. 3,211,232 discloses a typical retractable ball seat having a collet, a passageway through the collet, and a ball or drop plug. The ball or drop plug is disposed on the seat, preventing fluid from flowing through the passageway. As the fluid pressure above the ball or drop plug builds up, the fluid pressure actuates a tool connected to the retractable ball seat. Thereafter, the collet is moved from its retracted position to its expanded position and the ball or drop plug falls through the passageway. As a result, fluid is no longer being blocked by the retractable ball seat.

Although modifications of retractable ball seats have been made, such as those disclosed in U.S. Pat. No. 4,390,065 and U.S. Patent Application Publication No. 2005/0205264, the prior art utilized shear pins or other pressure building methods that caused the ball seat to release the ball only when a certain downhole pressure was reached. However, in some instances sufficient pressure may not be available. Alternatively, in some wells, pressure, even if available, cannot be utilized because additional intervention steps are required which results in the well experiencing undesirable "downtime" for the additional intervention steps. Additionally, in some instances, the shear pins fail to shear when they are supposed to, causing further delays.

Accordingly, prior to the development of the retractable ball and plug seats disclosed herein, the art has sought retractable ball and plug seats that can be activated to actuate downhole tools where pressure is unavailable to set the downhole tools and that can be activated after a known elapsed period of time.

SUMMARY OF INVENTION

Contrary to the prior retractable ball seats, the retractable ball seats disclosed herein include a dissolvable material that acts as a time delay for releasing the ball. The dissolvable materials can easily be calibrated to determine when they will sufficiently dissolve to release the ball.

Further, because the dissolvable materials can be easily calibrated, they can be customized for various depth wells without concern for the pressures within the well. The dissolvable materials can also be customized to sufficiently dissolve and release the ball within predetermined amounts of time.

Additionally, the inclusion of the dissolvable material to maintain the retractable ball seat in its retracted position permits the formation of various sized retractable ball seats without regard for the inner diameter of the housing of the retractable ball seat or the outer diameter of the retractable ball seat. As necessary, additional or less dissolvable material may be used to encase the seat and to properly fit within the bore of the housing of the retractable ball seat, thereby allowing the housing to change sizes, but the seat and ball to remain the same size.

Broadly, retractable ball seats having a housing, a seat, and a plug such as a ball are disclosed. The seat has a retracted position that prohibits the ball from passing through the passageway and an expanded position that permits the ball to pass through the passageway. In one specific embodiment, the seat is formed by collet. In another embodiment, the seat is formed by a ring.

A time delay material maintains the seat in the retracted position. The time delay material disintegrates, degrades, or dissolves within a known period of time such that the retractable ball seat can be placed in a desired location in the wellbore and the ball will be released through the passageway within a known period of time.

In accordance with one aspect of the invention, one or more of the foregoing advantages have been achieved through an apparatus for selectively closing a well conduit to enable pressure applied to the conduit to actuate a downhole tool. The apparatus comprises a housing for connection into a conduit disposed in a well and having a bore disposed longitudinally therein; a seat disposed within the bore, the seat having a retracted position and an expanded position; at least one dissolvable material operatively connected to the seat such that the at least one dissolvable material maintains the seat in the retracted position prior to dissolution; and a plug element adapted to be disposed into the conduit, the plug element landing on the seat and blocking fluid flow through the conduit when the seat is in the retracted position to enable fluid pressure to be applied to the conduit for actuating a well tool connected into the conduit, wherein, the movement of the seat from the retracted position to the expanded position is facilitated by dissolution of the dissolvable material, thereby permitting the plug element to pass completely through the seat.

A further feature of the apparatus is that the at least one dissolvable material may comprise a polymer. Another feature of the apparatus is that the polymer may comprise a biodegradable polymer. An additional feature of the apparatus is that the polymer may comprise a polyvinyl-alcohol based polymer. Still another feature of the apparatus is that the seat may move axially relative to an axis of the housing when moving from the retracted to the expanded position. A further feature of the apparatus is that the seat may comprise a collet having a tubular wall containing a plurality of slots that define fingers with free ends at the first end of the tubular wall, the fingers being flexible to define a smaller diameter at the free ends while in the retracted than when in the expanded position; and the dissolvable material may be located on an exterior portion of the collet for retaining the fingers in the retracted position until dissolution. Another feature of the apparatus is that the at least one dissolvable material may be disposed within the slots. An additional feature of the apparatus is that the seat may have at least one slot and the at least one dissolvable material may be disposed within the at least one slot. Still another feature of the apparatus is that the seat may be resiliently biased toward the expanded position.

A further feature of the apparatus is that the seat may comprise a collet sleeve having a base and a plurality of resilient fingers, terminating in free ends opposite the base, the free ends defining an inner diameter that is smaller than an inner diameter of the base while in the retracted position and an inner diameter at least equal to the inner diameter of the base while in the expanded position. Another feature of the apparatus is that the seat may comprise a collet sleeve having a base and a plurality of resilient fingers, terminating in free ends opposite the base; and wherein the apparatus may further comprise a recess in the bore of the housing, the free ends of the fingers being above the recess while in the retracted position; and the dissolvable material may prevent the collet sleeve from moving downward, until dissolved, to the expanded position wherein the free ends of the fingers spring outward into the recess.

In accordance with an additional aspect of the invention, one or more of the foregoing advantages also have been achieved through an improvement in a retractable ball seat located within a string of conduit in a well, the ball seat comprising an expandable collet for releasably trapping a plug member dropped down the conduit. The improvement comprises at least one dissolvable material disposed adjacent the expandable collet, preventing the expandable collet from expanding until the dissolvable material is dissolved.

A further feature of the improved retractable ball seat is that the at least one dissolvable material may comprise a polymer. Another feature of the improved retractable ball seat is that the polymer may comprise a biodegradable polymer. An additional feature of the improved retractable ball seat is that the dissolvable material may surround at least part of the collet to prevent the collet from expanding. Still another feature of the improved retractable ball seat is that the collet and the plug member may move axially relative to the conduit to expand, and the dissolvable material may prevent the axial movement. A further feature of the improved retractable ball seat is that the collet may comprise a sleeve having a base and a plurality of slots, defining flexible, resilient fingers with free ends opposite the base; and the dissolvable material may be located in the slots.

In accordance with an additional aspect of the invention, one or more of the foregoing advantages also have been achieved through a method of actuating a downhole tool disposed in the bore of a well. The method may comprise the steps of: (a) providing a seat having a retracted position and an expanded position; (b) lowering the seat and a downhole tool on a string of conduit into a bore of a well while the seat is retained in the retracted position with a dissolvable material; then (c) inserting a plug member into the conduit and landing the plug member on the seat; then (d) pumping fluid into the conduit, which is blocked by the plug member on the seat, thereby causing pressure within the conduit to increase to actuate the well tool; then (e) dissolving the dissolvable material; and then, (f) expanding the seat from the retracted position to the expanded position, and allowing the ball to move completely through the seat.

A further feature of the method of actuating a downhole tool disposed in the bore of a well is that the seat may be resiliently biased to the expanded position, and dissolution of the dissolvable material may allow the bias of the seat to move the seat to the expanded position. Another feature of the method of actuating a downhole tool disposed in the bore of a well is that, in step (f), the seat may be moved downward relative to the conduit.

The apparatuses and methods disclosed herein have one or more of the following advantages: permitting customization of the retractable ball seat; allowing the setting of the downhole tool in applications where pressure is unavailable to be use to set the downhole tool; allowing the setting of the downhole tool without additional intervention steps, thus, providing less well downtime during the additional intervention steps.

Figure 1:
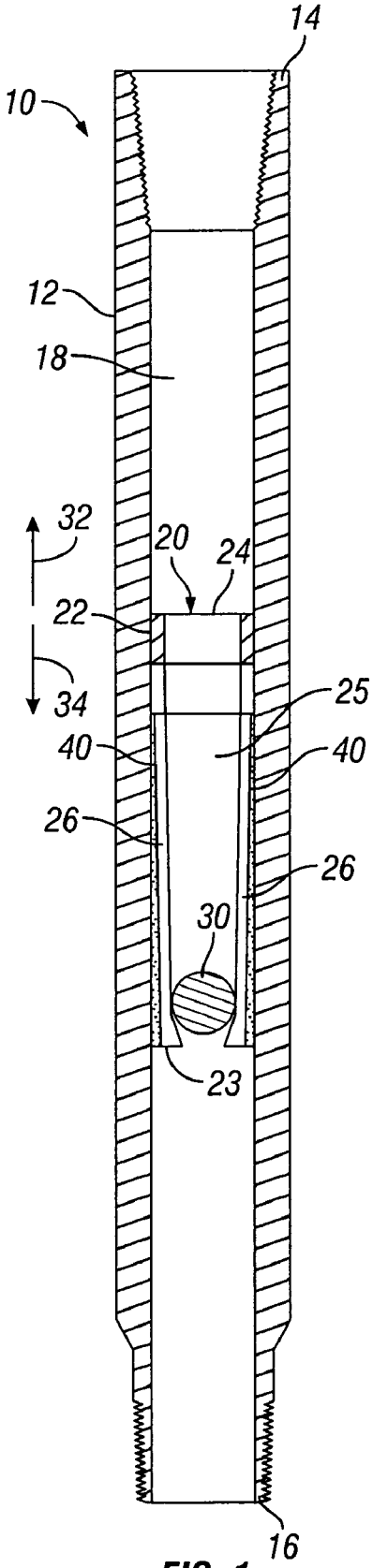
FIG. 1 is a partial cross-sectional view of a specific embodiment of the retractable ball seat disclosed herein shown in the retracted position.
Figure 2:
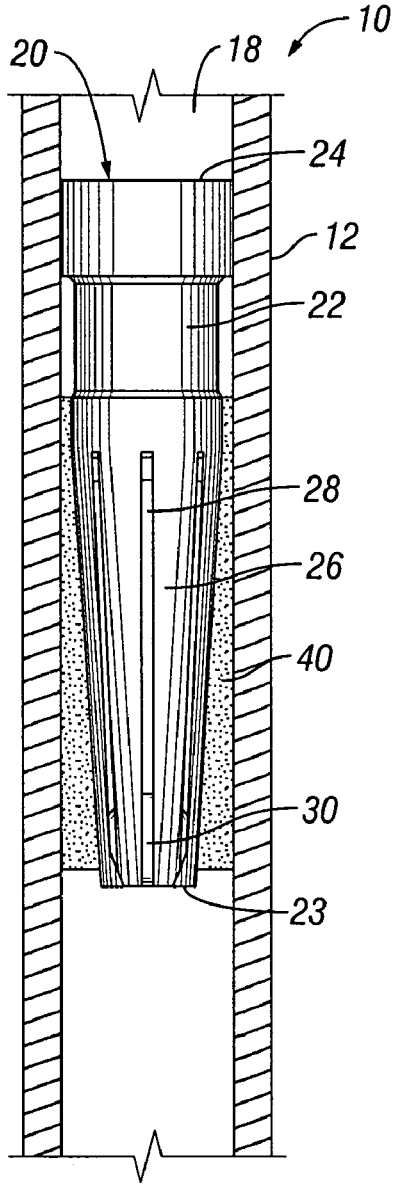
FIG. 2 is an enlarged partial cross-sectional view of the retractable ball seat shown in FIG. 1 shown in the retracted position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-4, apparatus or retractable ball seat 10 includes a sub or housing 12 having first end 14, second end 16, and bore 18. Housing 12 is dimensionally shaped to fit within the inner diameter of a wellbore such that the exterior surface of housing 12 is engaged with the inner diameter of the wellbore. Housing 12 has threaded upper and lower end for securing into a string of conduit, such as drill pipe or tubing.

Seat 20 is disposed within in bore 18. Although not shown, seat 20 is limited against axial movement in bore 18, such as by an internal shoulder. As shown in FIGS. 1-4, seat 20 comprises collet 22 having expandable end 23, open end 24 and passageway 25. Open end 24 of seat 20 is preferably a solid annular member. Collet 22 includes a plurality of collet fingers 26 having slots 28 disposed between each collet finger 26. In the retracted position of retractable ball seat 10 (FIGS. 1 and 2), ball 30 is disposed within passageway 25 and rests on seat 20 near the lower ends of collet fingers 26. In this embodiment, upward, toward the surface of the well (not shown), is in the direction of arrow 32 and downward or downhole (the direction going away from the surface of the well) is in the direction of arrow 34. Therefore, while in the retracted position, ball 30 has already passed through the majority of the length of passageway 25. Preferably, collet fingers 26 are resiliently biased to the expanded position shown in FIGS. 3 and 4.

Dissolvable material 40 is disposed around collet 22 and in slots 28. Dissolvable material maintains collet 22 in the retracted position (FIGS. 1 and 2), thereby preventing ball 30 from dropping out of passageway 25 in the direction of arrow 34. In this embodiment, the outer surface or diameter of dissolvable material 40 is in contact with the inner wall surface or diameter of housing 12. The dissolvable material 40 maintains collet 22 in the retracted position.

"Dissolvable" means that the material is capable of dissolution in a fluid or solvent disposed within the well or within bore 18 and, thus, passageway 25. "Dissolvable" is understood to encompass the terms degradable and disintegrable. Likewise, the terms "dissolved" and "dissolution" also are interpreted to include "degraded" and "disintegrated," and "degradation" and "disintegration," respectively. Dissolvable material 40 may be any material known to persons of ordinary skill in the art that can be dissolved, degraded, or disintegrated over an amount of time by a temperature or fluid such as water-based drilling fluids, hydrocarbon-based drilling fluids, or natural gas, and that can be calibrated such that the amount of time necessary for dissolvable material 40 to dissolve is known or easily determinable without undue experimentation. Suitable dissolvable materials 40 include polymers and biodegradable polymers, for example, polyvinyl-alcohol based polymers such as the polymer HYDROCENE™ available from 5 droplax, S.r.l. located in Altopascia, Italy, polylactide ("PLA") polymer 4060D from Nature-Works™, a division of Cargill Dow LLC; TLF-6267 polyglycolic acid ("PGA") from DuPont Specialty Chemicals; polycaprolactams and mixtures of PLA and PGA; solid acids, such as sulfamic acid, trichloroacetic acid, and citric acid, held together with a wax or other suitable binder material; polyethylene homopolymers and paraffin waxes; polyalkylene oxides, such as polyethylene oxides, and polyalkylene glycols, such as polyethylene glycols. These polymers may be preferred in water-based drilling fluids because they are slowly soluble in water.

In calibrating the rate of dissolution of dissolvable material 40, generally the rate is dependent on the molecular weight of the polymers. Acceptable dissolution rates can be achieved with a molecular weight range of 100,000 to 7,000,000. Thus, dissolution rates for a temperature range of 50° C. to 250° C. can be designed with the appropriate molecular weight or mixture of molecular weights.

In one embodiment, dissolvable material 40 dissolves, degrades, or disintegrates over a period of time ranging from 1 hour to 240 hours and over a temperature range from about 50° C. to 250° C. Preferably, both time in contact with a solvent and temperature act together to dissolve dissolvable material 40; however, the temperature should less than the melting point of dissolvable material 40. Thus, dissolvable material 40 does not begin dissolving solely by coming into contact with the solvent which may be present in the wellbore during running in of retractable ball seat 10. Instead, an elevated temperature must also be present to facilitate dissolution of dissolvable material by the solvent. Additionally, water or some other chemical could be used alone or in combination with time and/or temperature to dissolve dissolvable material 40. Other fluids that may be used to dissolve dissolvable material 40 include alcohols, mutual solvents, and fuel oils such as diesel.

It is to be understood that the apparatuses and methods disclosed herein are considered successful if dissolvable material 40 dissolves sufficiently such that seat 20 is moved from its retracted position (FIGS. 1 and 2) to its expanded position (FIGS. 3 and 4) so that ball 30 passes completely through passageway 25 bore of seat 20. In other words, the apparatuses and methods are effective even if all of dissolvable material 40 does not dissolve. In one specific embodiment, at least 50% of dissolvable material 40 dissolves. In other specific embodiment, at least 90% of dissolvable material 40 dissolves.

In one preferred embodiment, the apparatuses and methods disclosed herein are considered successful if dissolvable material 40 dissolves sufficiently such that seat 20 is moved from its retracted position (FIGS. 1 and 2) to its expanded position (FIGS. 3 and 4) so that ball 30 passes completely through passageway 25 of seat 20 and the inner wall of passageway 25 is smooth having a constant inner diameter.

In operation, retractable ball seat 10 is placed in a string (not shown) with a downhole tool (not shown), such as a packer or a bridge plug located above. The string is run into the wellbore to the desired location. Ball 30 is the dropped down the string, into bore 18 of housing 12, and landed on seat 20. Alternatively, ball 30 may be placed in housing 12 before running. The operator pumps fluid into the string. Ball 30 forms a seal against the collet fingers 26 because of dissolvable material 40 between them. Fluid (not shown) builds up above ball 30 until the pressure is sufficiently great to actuate the downhole tool. After the downhole tool is actuated, it is desirable to remove ball 30 from seat 20 so fluid can flow through the string.

Figure 3:
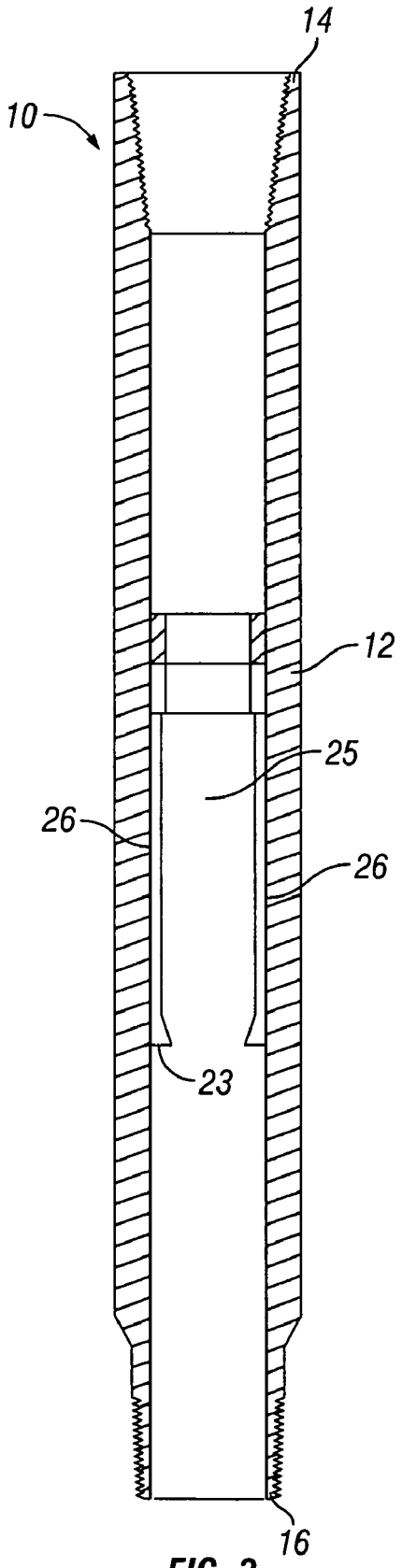
FIG. 3 is a partial cross-sectional view of the retractable ball seat shown in FIG. 1 shown in the expanded position.
Figure 4:
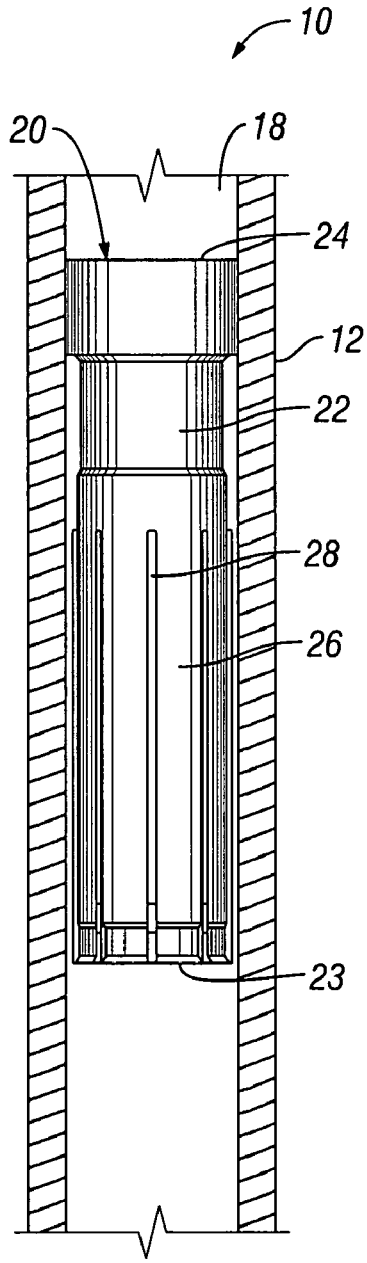
FIG. 4 is an enlarged partial cross-sectional view of the retractable ball seat shown in FIG. 3 shown in the expanded position.

During the build up of pressure to actuate the downhole tool, the fluid is also in contact with dissolvable material 40, causing dissolvable material 40 to dissolve. As will be recognized by persons of ordinary skill in the art, the amount of time for dissolvable material 40 to sufficiently dissolve to release ball 30 is greater than the amount of time for the pressure to actuate the downhole tool. After a certain amount of time, preferably predetermined, after actuation of the downhole tool, dissolvable material 40 sufficiently dissolves such that seat 20 moves from the retracted position (FIGS. 1 and 2) to the expanded position (FIGS. 3 and 4). As a result, ball 30 is released from seat 20. Preferably, the resiliency of collet fingers 26 assist by springing outwardly after dissolvable material 40 dissolves.

In another preferred embodiment, dissolvable material 40 includes a dissolvable support (not shown). The dissolvable support is sturdier than dissolvable material 40. The dissolvable support may be any material known to persons of ordinary skill in the art. In one embodiment, the dissolvable support is TAFA Series 300-301 Dissolvable Metal from TAFA Incorporated of Concord, N.H.

Although the apparatus described in greater detail with respect to FIGS. 1-4 is retractable ball seat 10 having ball 30, it is to be understood that the apparatuses disclosed herein may be any type of retractable seat known to persons of ordinary skill in the art. For example, the apparatus may be a retractable drop plug seat, wherein the drop plug temporarily blocks the flow of fluid through the wellbore. Therefore, the term "plug" as used herein encompasses ball 30 as well as any other type of device that is used to temporary block the flow of fluid through the wellbore.

Figure 5:
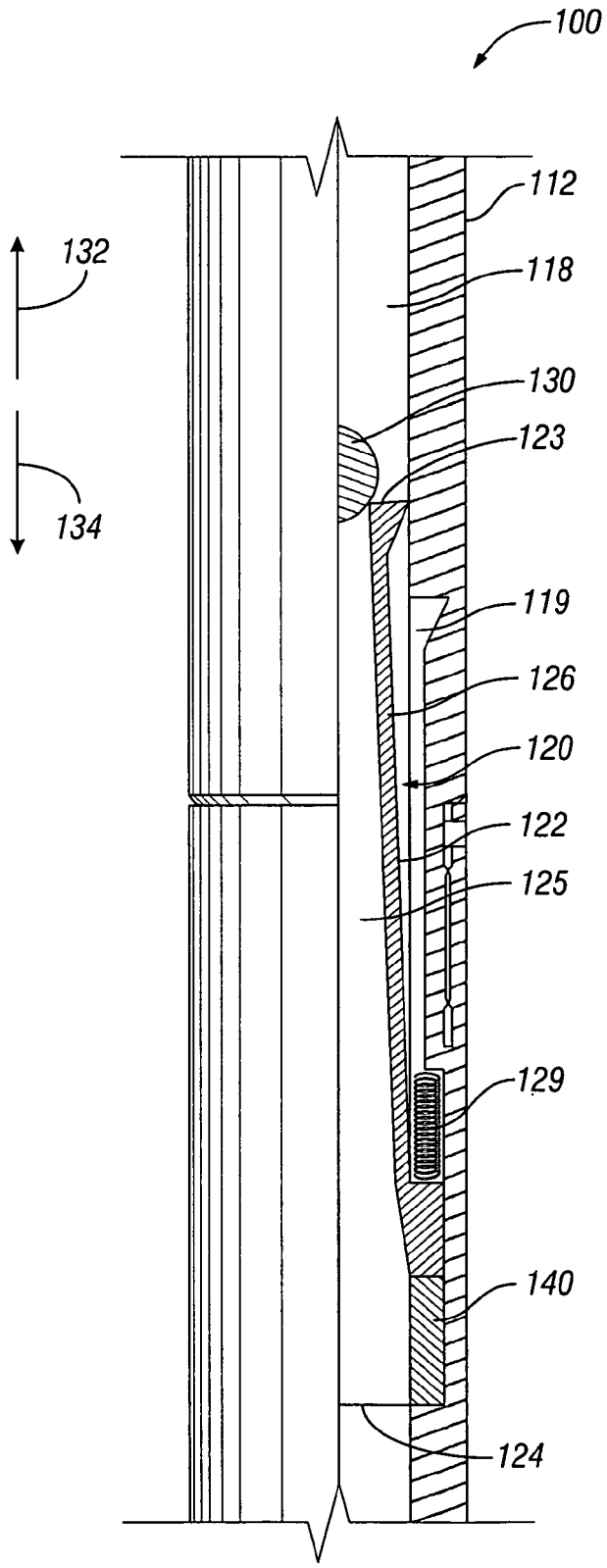
FIG. 5 is an enlarged partial cross-sectional view of another specific embodiment of the retractable ball seat disclosed herein shown in the retracted position.

As illustrated in FIG. 5, in another embodiment, retractable ball seat 100 includes housing 112 having one or more recesses 119 disposed on the inner wall surface within bore 118 of housing 112. Seat 120 comprises collet 122 having expandable end 123, open lower end 124, and passageway 125. Open lower end 124 is a solid ring. Collet 122 includes a plurality of collet fingers 126 having slots 128 disposed between each collet finger 126. Collet fingers 126 are preferably resilient and biased outwardly. The free upper ends of collet fingers 126 are at the upper end of collet 22. In the retracted position of retractable ball seat 110, ball 130 is disposed outside passageway 125 and rests on top of seat 120. In this embodiment, upward, toward the surface of the well (not shown), is in the direction of arrow 132 and downward or downhole (the direction going away from the surface of the well) is in the direction of arrow 134.

Spring 129 is disposed around collet fingers 126 and dissolvable material 140 is disposed below spring 129. Dissolvable material 140 is formed in the shape of a sleeve having an outer diameter engaging a recess in housing 112 and an inner diameter equal to a minimum inner diameter of bore 118. Spring 129 urges collet 122 downward, however, dissolvable material 140 restricts movement of collet 122 downward.

The embodiment shown in FIG. 5 operates in a similar manner as the embodiment shown in FIGS. 1-4 except that when dissolvable material 40 sufficiently dissolves, collet 122 drops down in direction of arrow 134 due to the pressure of fluid above ball 130 begin applied from the surface of the well. As collet fingers 126 drop, they slide downward and spring out due to their resiliency into corresponding recesses 119. Spring 129 facilitates movement of collet fingers 126 downward because after dissolvable material 40 is dissolved, the downward force from spring 129 is not longer retained and spring 129 expands collet 122 downward. Due to the movement of collet fingers 126 downward and into corresponding recesses 119, the inner diameter of housing 112 becomes smooth, i.e., maintains a constant inner diameter through bore 118 and passageway 125.

It is to be understood that the invention is not limited to the exact details of construction, operation, exact materials, or embodiments shown and described, as modifications and equivalents will be apparent to one skilled in the art. For example, the seat can be disposed within the passageway such that the ball is disposed within the passageway when the seat is in the retracted position and the ball drops out of the passageway when the seat is placed in the expanded position. Alternatively, the seat may be disposed outside the passageway such that the ball is landed outside the passageway when the seat is in the retracted position and the ball drops through the passageway when the seat is moved to the expanded position. Further, the ball may be any plug element known to persons of ordinary skill in the art. Examples include darts and drop plugs. Accordingly, the invention is therefore to be limited only by the scope of the appended claims.

What is claimed is:

1. An apparatus for selectively closing a well conduit to enable pressure applied to the conduit to actuate a downhole tool, the apparatus comprising:

a housing for connection into a conduit disposed in a well and having a bore disposed longitudinally therein;

a seat disposed within the bore, the seat having a non-dissolvable expandable member having a retracted position and an expanded position;

at least one dissolvable material operatively associated with the non-dissolvable expandable member such that the at least one dissolvable material maintains the non-dissolvable expandable member in the retracted position prior to dissolution; and a plug element adapted to be disposed into the conduit, the plug element landing on the seat and blocking fluid flow through the conduit when the non-dissolvable expandable member is in the retracted position to enable fluid pressure to be applied to the conduit for actuating a well tool connected into the conduit, wherein, the movement of the non-dissolvable expandable member from the retracted position to the expanded position is facilitated by dissolution of the dissolvable material, thereby permitting the plug element to pass completely through the seat.

2. The apparatus of claim 1, wherein the at least one dissolvable material comprises a polymer.

3. The apparatus of claim 2, wherein the polymer comprises a bio-degradable polymer.

4. The apparatus of claim 2, wherein the polymer comprises a polyvinyl-alcohol based polymer.

5. The apparatus of claim 1, wherein the non-dissolvable expandable member moves axially relative to an axis of the housing when moving from the retracted to the expanded position.

6. The apparatus of claim 1, wherein the non-dissolvable expandable member comprises a collet having a tubular wall containing a plurality of slots that define fingers with free ends at the first end of the tubular wall, the fingers being flexible to define a smaller diameter at the free ends while in the refracted than when in the expanded position; and the dissolvable material is located on an exterior portion of the collet for retaining the fingers in the retracted position until dissolution.

7. The apparatus of claim 6, wherein the at least one dissolvable material is disposed within the slots.

8. The apparatus of claim 1, wherein the non-dissolvable expandable member has at least one slot and the at least one dissolvable material is disposed within the at least one slot.

9. The apparatus of claim 8, wherein the non-dissolvable expandable member is resiliently biased toward the expanded position.

10. The apparatus of claim 1, wherein the non-dissolvable expandable member comprises:

a collet sleeve having a base and a plurality of resilient fingers, terminating in free ends opposite the base, the free ends defining an inner diameter that is smaller than an inner diameter of the base while in the retracted position and an inner diameter at least equal to the inner diameter of the base while in the expanded position.

11. The apparatus of claim 1, wherein the non-dissolvable expandable member comprises:

a collet sleeve having a base and a plurality of resilient fingers, terminating in free ends opposite the base; and wherein the apparatus further comprises:

a recess in the bore of the housing, the free ends of the fingers being above the recess while in the retracted position; and the dissolvable material prevents the collet sleeve from moving downward, until dissolved, to the expanded position wherein the free ends of the fingers spring outward into the recess.

12. An improvement in a retractable ball seat located within a string of conduit in a well, the ball seat comprising an expandable collet for releasably trapping a plug member dropped down the conduit, the improvement comprising:

at least one dissolvable material disposed adjacent the expandable collet, preventing the expandable collet from expanding until the dissolvable material is dissolved.

13. The retractable ball seat of claim 12, wherein the at least one dissolvable material comprises a polymer.

14. The retractable ball seat of claim 12, wherein the polymer comprises a bio-degradable polymer.

15. The retractable ball seat of claim 12, wherein the dissolvable material surrounds at least part of the collet to prevent the collet from expanding.

16. The retractable ball seat of claim 12, wherein the collet and the plug member move axially relative to the conduit to expand, and the dissolvable material prevents the axial movement.

17. The retractable ball seat of claim 12, wherein the collet comprises a sleeve having a base and a plurality of slots, defining flexible, resilient fingers with free ends opposite the base; and the dissolvable material is located in the slots.

18. A method of actuating a downhole tool disposed in the bore of a well, the method comprising the steps of:

(a) providing a seat having a retracted position and an expanded position;

(b) lowering the seat and a downhole tool on a string of conduit into a bore of a well while the seat is retained in the retracted position with a dissolvable material; then (c) inserting a plug member into the conduit and landing the plug member on the seat; then (d) pumping fluid into the conduit, which is blocked by the plug member on the seat, thereby causing pressure within the conduit to increase to actuate the well tool; then (e) dissolving the dissolvable material; and then, (f) expanding the seat from the retracted position to the expanded position, and allowing the ball to move completely through the seat.

19. The method of claim 18, wherein the seat is resiliently biased to the expanded position, and dissolution of the dissolvable material allows the bias of the seat to move the seat to the expanded position.

20. The method of claim 19, wherein in step (f), the seat is moved downward relative to the conduit.

21. An apparatus for selectively closing a well conduit to enable pressure applied to the conduit to actuate a downhole tool, the apparatus comprising:

a housing for connection into a conduit disposed in a well and having a bore disposed longitudinally therein;

a seat disposed within the bore, the seat having a retracted position and an expanded position;

at least one dissolvable material operatively connected to the seat such that the at least one dissolvable material maintains the seat in the retracted position prior to dissolution, the at least one dissolvable material comprises a bio-degradable polymer; and a plug element adapted to be disposed into the conduit, the plug element landing on the seat and blocking fluid flow through the conduit when the seat is in the retracted position to enable fluid pressure to be applied to the conduit for actuating a well tool connected into the conduit, wherein, the movement of the seat from the retracted position to the expanded position is facilitated by dissolution of the dissolvable material, thereby permitting the plug element to pass completely through the seat.

22. An apparatus for selectively closing a well conduit to enable pressure applied to the conduit to actuate a downhole tool, the apparatus comprising:

a housing for connection into a conduit disposed in a well and having a bore disposed longitudinally therein;

a seat disposed within the bore, the seat having a retracted position and an expanded position;

at least one dissolvable material operatively connected to the seat such that the at least one dissolvable material maintains the seat in the retracted position prior to dissolution, the at least one dissolvable material comprises a polyvinyl-alcohol based polymer; and a plug element adapted to be disposed into the conduit, the plug element landing on the seat and blocking fluid flow through the conduit when the seat is in the refracted position to enable fluid pressure to be applied to the conduit for actuating a well tool connected into the conduit, wherein, the movement of the seat from the refracted position to the expanded position is facilitated by dissolution of the dissolvable material, thereby permitting the plug element to pass completely through the seat.

23. An apparatus for selectively closing a well conduit to enable pressure applied to the conduit to actuate a downhole tool, the apparatus comprising:

a housing for connection into a conduit disposed in a well and having a bore disposed longitudinally therein;

a seat disposed within the bore, the seat having a refracted position and an expanded position and the seat moving axially relative to an axis of the housing when moving from the refracted to the expanded position;

at least one dissolvable material operatively connected to the seat such that the at least one dissolvable material maintains the seat in the refracted position prior to dissolution; and a plug element adapted to be disposed into the conduit, the plug element landing on the seat and blocking fluid flow through the conduit when the seat is in the refracted position to enable fluid pressure to be applied to the conduit for actuating a well tool connected into the conduit, wherein, the movement of the seat from the refracted position to the expanded position is facilitated by dissolution of the dissolvable material, thereby permitting the plug element to pass completely through the seat.

* * * * *